United States Patent [19]

Heyward

[11] Patent Number: 4,936,554

[45] Date of Patent: Jun. 26, 1990

[54] DEVICE FOR AUTOMATICALLY RAISING AND LOWERING OF MOBILE ELEMENTS OF CHAIRS AND BEDS

[76] Inventor: Bernard Heyward, 2 Boulevard Gambetta, 38000 Brenoble, France

[21] Appl. No.: 253,430

[22] Filed: Oct. 4, 1988

[51] Int. Cl.[5] ..... E05F 1/10

[52] U.S. Cl. ..... 267/64.16; 5/68; 92/133; 267/64.12

[58] Field of Search ..... 267/64.11, 64.12, 64.15, 267/64.16; 16/1 C; 5/433, 62, 64, 66, 67, 68; 92/8, 14, 13 DB, 133; 248/162.1, 364, 325

[56] References Cited

U.S. PATENT DOCUMENTS

| | | | |
|---|---|---|---|
| 2,438,059 | 3/1948 | Lackey | 5/68 |
| 2,582,565 | 1/1952 | Schnippel et al. | 5/68 |
| 3,018,791 | 1/1962 | Knox | 92/133 |
| 3,127,619 | 4/1967 | Bronstien | 5/68 |
| 3,960,667 | 6/1976 | Dutchburn | 248/364 |

FOREIGN PATENT DOCUMENTS

| | | | |
|---|---|---|---|
| 2362029 | 6/1974 | Fed. Rep. of Germany . | |
| 1542464 | 10/1968 | France . | |
| 0074880 | 3/1983 | France | 16/1 C |
| 2077859 | 12/1981 | United Kingdom | 5/67 |

*Primary Examiner*—Douglas C. Butler
*Assistant Examiner*—Matthew C. Graham
*Attorney, Agent, or Firm*—Browdy & Neimark

[57] ABSTRACT

A device raising and lowering bed or chairs including a pneumatic spring associated with each mobile element of the chair or bed and placed to allow, by its extension, raising of this mobile element. Each pneumatic spring is associated with a weight acting against it and able to be moved to compensate, at rest, the force of the pneumatic spring relative to the weight of the person resting of this mobile element. The device can be used by any person, invalid or not, without the needed of any effort on his part and without the assistance of another person.

20 Claims, 5 Drawing Sheets

DEVICE FOR AUTOMATICALLY RAISING AND LOWERING OF MOBILE ELEMENTS OF CHAIRS AND BEDS

BACKGROUND OF THE INVENTION

1. Field of the Invention

This invention relates to a device for automatically raising and lowering adjustable mobile elements of chairs and beds and is intended particularly, in the case of chairs and beds for invalids, to permit the operation by the invalids of these adjustable elements without requiring special effort on their part.

2. The Prior Art

Devices are already known, driven by motor or hydraulically, to modify the inclination of the backs, bed surfaces and support surfaces of chairs and beds. Now, motor-driven devices are expensive in design and are used only with special chairs and beds. Adjustment devices operating hydraulically are also extremely expensive.

FR No. 1 542 464 has proposed a device making it possible to raise and lower adjustable elements of chairs and beds, which uses a pneumatic spring that is continuously adjustable and actuated by a handle.

The user of a pneumatic spring is actually at an advantage because such a spring, because of its particular structure, is always able to keep the element to be adjusted approximately in balance. For this reason, it suffices, after unlocking of the cylinder by the person on the bed or chair, to exert a relatively slight force to cause a break in the balance and to allow the movement of the element to be regulated in the desired direction. Further, a pneumatic spring is much less expensive than the motors or hydraulic systems used up to now.

However, in the device of this FR No. 1 542 464, the person, seated on the chair or lying in the bed, must exert a rather considerable force at the level of the abdominal muscles particularly to lower or raise the mobile element. The device therefore cannot be used by very weak persons confined to bed or having only slight abdominal musculation.

Further, this FR No. 1 542 464 shows only an embodiment for swinging the back of a bed and shows a very complicated system for controlling the pneumatic cylinder.

SUMMARY OF THE INVENTION

The object of this invention is to eliminate these drawbacks and to provide a device for automatically raising and lowering the adjustable elements of chairs and beds, which can be used by an invalid, without any effort on the part of the latter and without the assistance of another person.

The object of the present invention is also to provide a system for controlling the adjustment device that is directly accessible to the invalid, even if, for example, the lower part of the bed or chair is involved, i.e., the part intended to receive the lower limbs of the invalid.

This object is achieved in the device according to the invention, which is of the type comprising a pneumatic spring associated with each mobile element of the chair or bed and placed to allow, by its extension, raising of this mobile element, in that with each pneumatic spring is associated a weight acting against it and able to be moved to compensate for, at rest, the force of the pneumatic spring relative to the weight of the person resting on this mobile element.

Actually, the pneumatic spring should be selected to exert a force that can take into account the different weights of persons. The fact of providing a compensation weight makes it possible perfectly to balance, at rest, the action of the pneumatic spring and that of the mobile element, so that a very slight lightening of this mobile element will suffice to allow the extension of the cylinder and the movement of the mobile element.

According to a first embodiment of the invention, each pneumatic spring is of the self-locking type and its unlocking is performed by a handle connected to a shaft able to cause, by movement of a pin, the actuation of the rod of the pneumatic spring being considered.

Advantageously, the compensation weight is mounted to able to be moved, in the direction of the coupling of the mobile element to the chair or bed, simultaneously with the actuation of the release control of the pneumatic spring.

For this reason, the moment of resistance exerted by the compensation weight relative to the coupling diminishes, which allows extension of the cylinder without any raising effort of the person being necessary.

This embodiment is particularly advantageous in the case of mobile elements used as footrests, because the weight of the legs and considerable muscular effort required at the level of the abdominal muscles to lift it.

According to a second embodiment of the device, each pneumatic spring associated with a mobile element has a spring rod mounted free in translation between two extension and retraction end positions. Therefore a locking system of the rod independent of the pneumatic spring is provided

BRIEF DESCRIPTION OF THE DRAWINGS

In any case, the device according to the invention and other characteristics of the invention will be brought out with the following description with reference to the accompanying diagrammatic drawings illustrating, by way of nonlimiting example, two preferred embodiments, in which.

DETAILED DESCRIPTION OF THE PREFERRED EMBODIMENT

Figure 1:
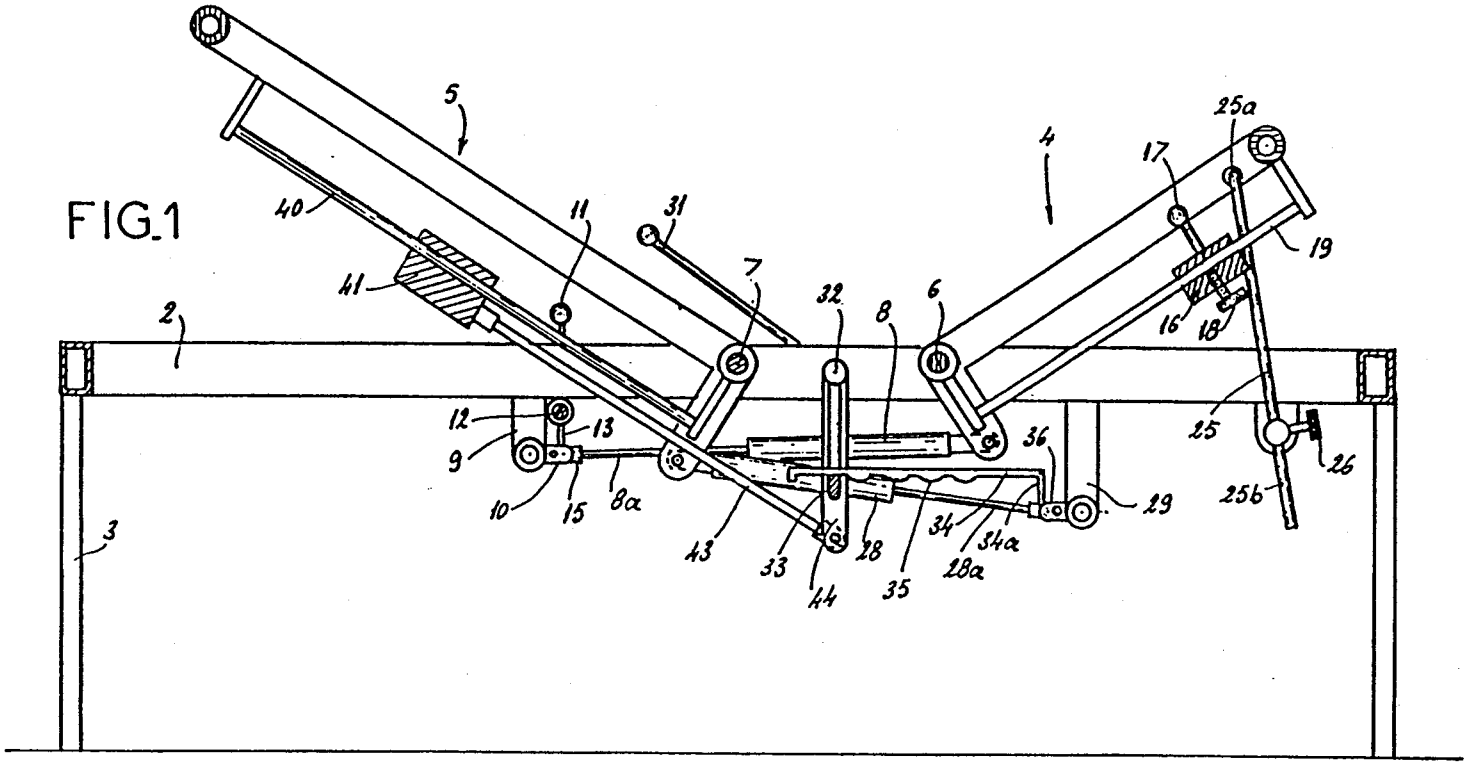
FIG. 1 is a view in section along I—I of FIG. 2 of the frame of a bed equipped with the device in its first embodiment according to the invention.
Figure 2:
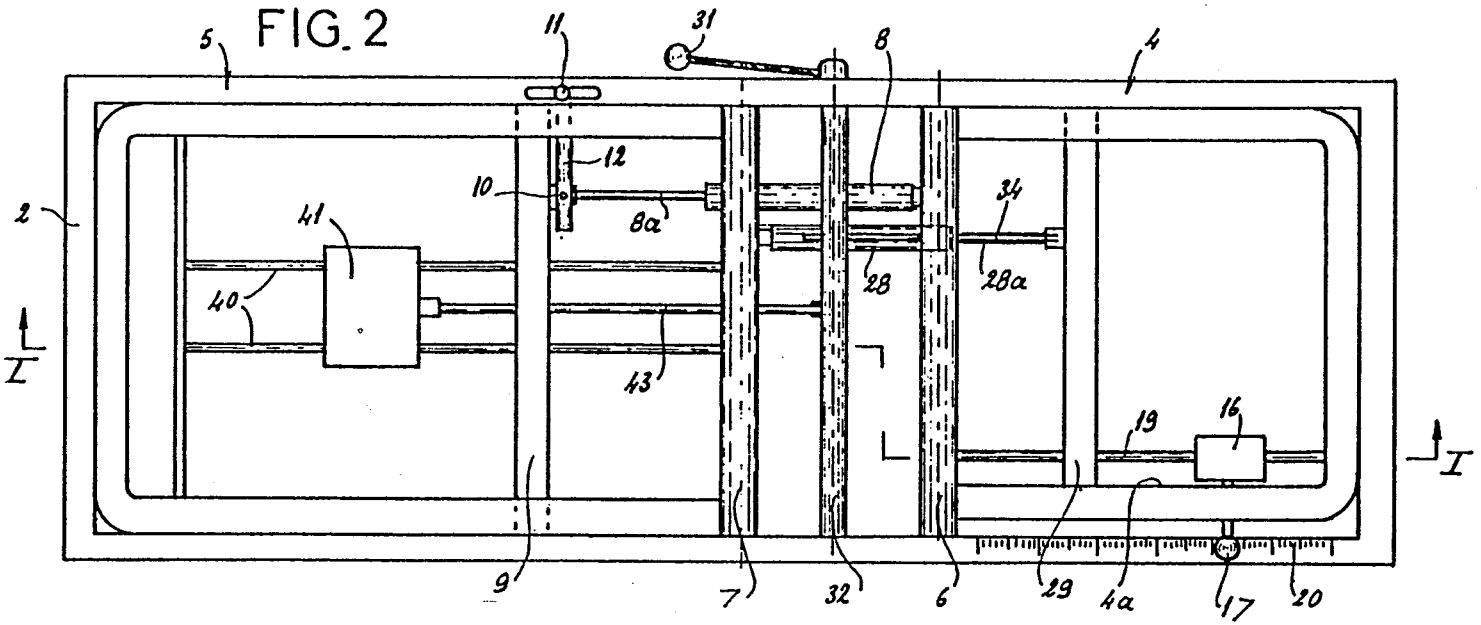
FIG. 2 is a top view of the bed frame of FIG. 1.

FIGS. 1 to 5 show the application of the device according to the invention in its first embodiment to a bed for invalids. This bed is formed by a frame consisting of a rectangular frame 2 and feet 3. To frame 2 are coupled two mobile elements 4 and 5 intended to be used as headrest and footrest. Each of these elements 4–5 is coupled at the level of the central part of the bed along coupling shafts 6 and 7, respectively. It will be noted that only the structure of the bed is represented on the figures and that elements such as box springs and mattress have been removed for greater simplicity.

A pneumatic spring 8 is coupled between a crossbar 9, located in the lower part, i.e., where the footrest is located, of the bed and headrest element 4 itself. This spring is placed to cause, by its extension, the upward swinging of element 4 by rotation around its shaft 6. Coupling of this spring 8 is performed in a way known in the art by means of straps 10.

A handle 11 makes it possible to put into movement pneumatic spring 8 which is of the self-locking type spring. This handle 11 is connected to a shaft 12 extending crosswise and provided on its free end with a pin 13 which is to able to act on end 8*a* of the rod of pneumatic spring 8 to cause the extension of the latter.

Figure 3:
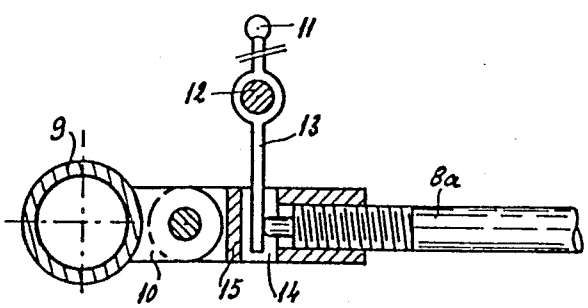
FIG. 3, on an enlarged scale, is a detail view of the unlocking system of a pneumatic spring according to the first embodiment of the device.

FIG. 3 shows the detail of embodiment of this actuating pin 13. The latter engages in a hole 14 made in a cylindrical sleeve 15 through which rod 8*a* of pneumatic spring 8 projects and which is coupled to crossbar 9 by means of strap 10. It can easily be seen that pivoting of handle 11 will cause movement of pin 13 and consequently actuation of rod 8*a* of the pneumatic spring.

On headrest 4 is also placed, on one of sides 4*a* of the latter, a bar 19 extending parallel to this side. A weight 16 is mounted to slide on this bar 19. This weight 16 can be moved by means of a handle 17 and can be locked in a set position by means of a screw 18. This weight 16 makes it possible to set the lifting device of the headrest element as a function of the weight of the person lying on the bed. A graduated scale 20 can be placed for this purpose on frame 2 of the bed parallel to bar 19, this scale being calibrated in kg and graduated, for example, from 10 to 200 kg.

Further, a safety system can be provided to assure that headrest element 4 is held in the raised position. This safety system consists of a rod 25 coupled at it upper end to the framework of mobile element 4 and able to be locked at its lower end 25*b* on frame 2 of the bed, by means of a thumb screw 26 or the like. This locking can be performed, for example, by medical personnel.

The operation of the lifting device for headrest element 4 is the following. Once the invalid has been placed on the bed, a setting as a function of the latter's weight is made by movement of weight 16 along bar 19. When the invalid wishes to lift this element 4 from the low position, it suffices to actuate handle 11 and to lift the head slightly to discharge pneumatic spring 8, this action being sufficient to permit extension of the spring once it has been unlocked. Actuation of this handle actually causes the movement of the rod of pneumatic spring 8 as indicated above and consequently causes the rotation of element 4 around its shaft 6 under the action of this pneumatic spring.

Lifting of footrest element 5 can be achieved in the same way with a pneumatic spring 28. This spring 28 is coupled between a crossbar 29 located in the upper part of the bed, i.e., the part where headrest 4 is located, and footrest 5 itself. Coupling of this spring 28 to crossbar 29 and element 5 is also achieved n a way known in the art by means of straps 10.

Handle 31 permits actuation of this pneumatic spring 28. This handle 31 is fastened to one end of a shaft 32 extending crosswise to frame 2 of the bed and mounted to rotate on it. A U-shaped yoke 33 is fastened, solidly in rotation, to this shaft 32. On the bottom of this yoke 33 rests an actuating rod 34 having approximately the shape of an L whose curved or bent part 34*a* is engaged in a sleeve 36 which makes it possible to connect rod 28*a* of the pneumatic spring to strap 10 for fastening of the latter to crossbar 29.

During pivoting of handle 31, yoke 33 also pivots and thereby causes the rotation of actuating rod 34. By this rotation, actuating rod 34 exerts, by its curved or bent part 34*a*, a thrust at the end of the rod of the pneumatic spring as explained above in connection with pneumatic spring 8, and causes unlocking of this pneumatic spring.

Actuating rod 34 also exhibits several setbacks 35 (in the present case, 4 in the example of the drawing) whose role will be explained below. Below footrest element 5 are placed two parallel bars 40 extending in the longitudinal direction of this element. A weight 41 is mounted to slide along these bars 40. Further, this weight 41 is connected to shaft 32 by a rod 43 and a link 44 to which this rod is coupled. Thus, the movement of weight 41 along bars 40 is controlled by actuation of handle 31.

In this case, operation of the lifting device of footrest element 5 is the following. When the invalid wishes to lift this element 5, he actuates handle 31. This actuation has the effect of causing the movement of weight 41 in the direction of coupling shaft 7 of the latter. Thereby, the moment relative to shaft 7 exerted by this weight diminishes and starting from a certain value becomes slight enough to allow pneumatic spring 28 to cause the upward movement of this element 5 by rotation relative to its shaft 7.

It will be noted that providing this weight 41, which acts in opposition to spring 28, makes it possible to obtain compensation for the weight of the invalid relative to the force exerted by pneumatic spring 28. Actually, pneumatic spring 28 should be selected to be powerful enough to allow lifting o the footrest element when a person of heavy weight is on it. Consequently, weight 41 enables a person of less weight to compensate for the difference in force opposing that of pneumatic spring 28. On the other hand, the additional weight caused by weight 41 should be reduced if it is desired to lift footrest element 5, which is achieved by movement of this weight 41 in the direction of the coupling shaft. This arrangement therefore enables a invalid to lift the footrest element of his bed without having to exert any force to lift his legs, which is particularly advantageous especially in the case of an invalid having weak abdominal muscles musculation.

Actually, if compensation weight 41 could not be moved, the invalid, to lift element 5, would have to lift his legs, and therefore exert a certain muscular force to make possible a movement by means of pneumatic springs.

Now, in the case of very weak persons, such an effort cannot be made by them and lifting of the mobile elements of the bed must be done by another person in the case of the usual system simply using a pneumatic spring. Providing the compensation device according to the invention therefore enables a person to perform different operations without exerting any muscular force, the effort made to raise the head in the first case being quite reduced.

It will be noted that in the case of footrest element 5, setbacks 35 allow actuation of spring 28 to be triggered starting only with a certain position of weight 41 as a function of the weight of the person. Actually, as long as weight 41 is in such a position that its force will oppose the movement of the pneumatic spring, yoke 33 will pass over setbacks 35 without causing a rotation of actuation rod 34 because of the self-locking system of pneumatic spring 28.

Only when weight 41 reaches a position in which the action that it exerts, joined with that of element 5 and of the weight of the invalid, is less than that of pneumatic spring 28, will it be able to be unlocked by rod 34.

Figure 4:
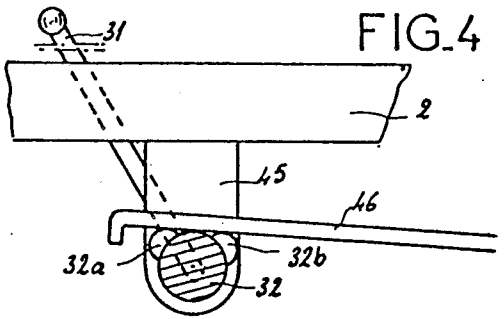
FIG. 4, on an enlarged scale, is a detail view of a variant of the actuating system of the rod for unlocking the spring assuring lifting of one of the mobile elements of the bed.

In the variant represented in FIG. 4, handle 31 makes it possible to cause pivoting of shaft 32 fastened to the end of a crossbar 45 located under frame 2. This shaft 32 is provided with two bosses **32*a* and 32*b* provided to cause the pivoting of smooth rod 46 for unlocking spring 28**.

Figure 5:
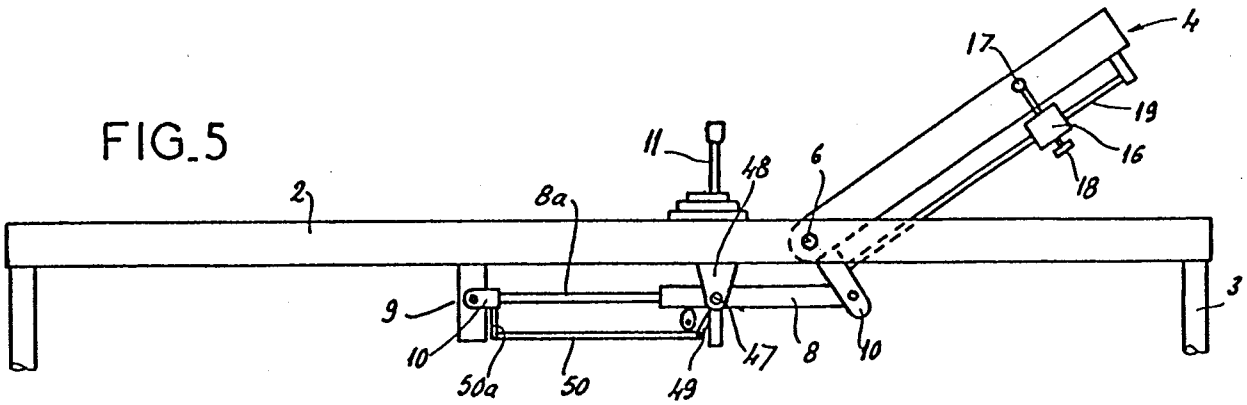
FIG. 5 is a side view of the bed frame showing another variant of the actuating system of the rod for unlocking the spring assuring lifting of one of the mobile elements of the bed.

FIG. 5 shows another variant of the system for actuating the rod for unlocking the spring assuring the lifting of one of the mobile elements of the bed. In this figure, the same elements are designated by the same references as above.

Self-locking pneumatic spring 8 associated with mobile element 4 is coupled between a crossbar 9 and headrest element 4 itself. This spring is placed to cause, by its extension, the upward swinging of element 4 by rotation around its shaft 6. Coupling of this spring 8 is performed in a way known in the art by means of straps 10.

Handle 11 makes it possible to put pneumatic spring 8 into motion. This handle 11 is solidly connected with a shaft 47 extending crosswise and mounted rotatably mobile on an anchoring lug 48 by means of a rivet. A device known in the art is also provided for regulating the height of handle 11 to position it relative to the mattress, this device comprising a ball housed in the shaft, thrust by a spring and intended to engage in one of the notches made on handle 11.

Shaft 47, moreover, being solidly connected by welding to two lugs 49, to the free ends of which are coupled, by one of its ends, an unlocking rod 50, whose curved or bent part **50*a* is engaged in sleeve 15 which makes it possible to connect rod 8*a* of pneumatic spring 8 to strap 10 for fastening to crossbar 9**.

During actuation of handle 11, shaft 47 pivots and causes the movement of unlocking rod 50 in the direction of mobile element 4. Curved or bent part **50*a* then exerts a thrust at the end of rod 8*a* of the spring and thus causes unlocking of said rod 8*a* which can slide freely in the spring, as explained in the description of other actuating systems for unlocking self-locking pneumatic spring according to the invention. The operation of lifting associated mobile elements 4 and 5** are, of course, also identical.

Of course, weight 41 at the level of footrest element 5 could be mounted moveably along one side of the bed as in the case of weight 16 and a locking system similar to rod 25 could also be provided for this element 5.

Also, weight 16 could be designed to be able to be moved to lighten the force exerted on spring 28 at the same time that it is unlocked, thus eliminating any effort for the invalid. Movement of one or other of the two weights 16 or 41 could also be obtained by rotation of a micrometer screw on which these weights move, such a system allowing a continuous adjustment of the position of the two weights.

It will also be noted that a graduation similar to graduation 20 can be provided for weight 41.

A system of notches with a ball acted on by a spring can also be provided between weight 41 and rod 40 on which it can slide to regulate the position of the weight in a discontinuous manner.

Also, the actuating system with yoke 33 of rod 34 can be replaced by an eccentric system carried by shaft 32, and rod 34 can exhibit only two setbacks 35 corresponding to end weight values.

FIGS. 6 to 9 show the second embodiment of the device according to the invention in its application to a bed for an invalid. In these figures the same elements are designated by the same references as above.

Figure 6:
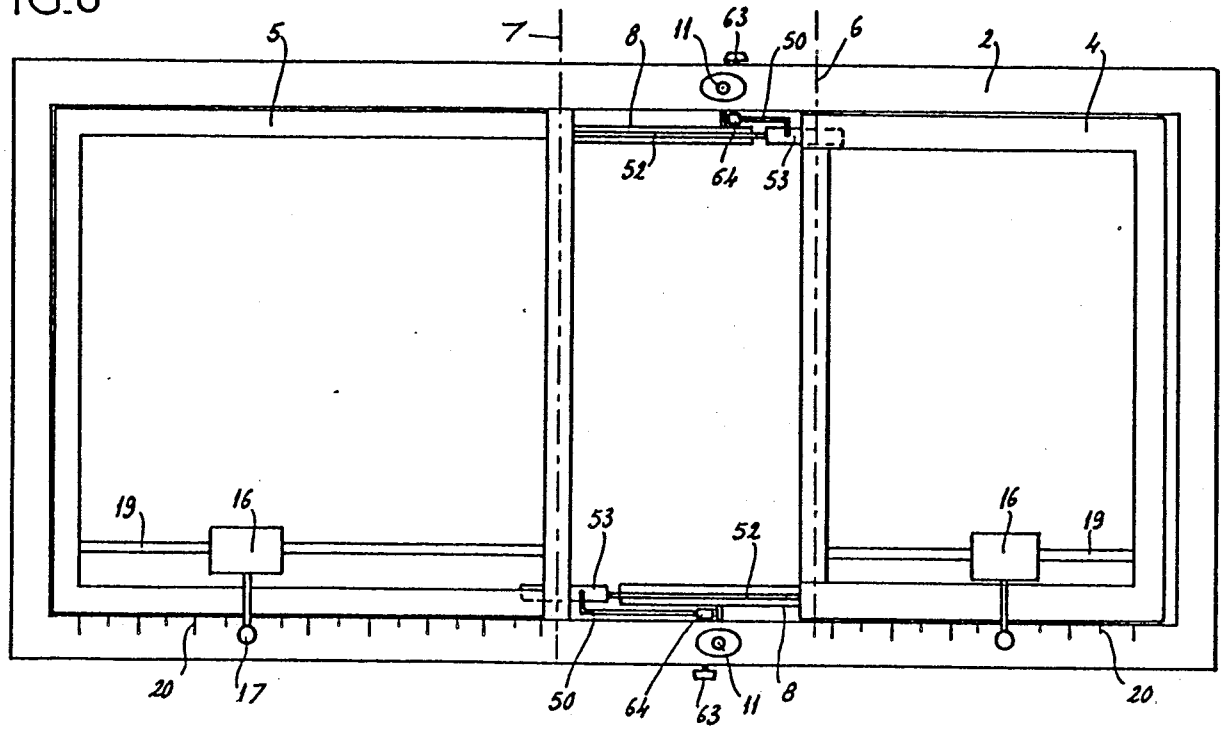
FIG. 6 is a top view of the frame of a bed equipped with the device in its second embodiment according to the invention.

As FIG. 6 shows, two elements 4 and 5 are coupled to frame 2 of the bed which are intended to serve as headrest and footrest, respectively. Each mobile element 4 and 5 is coupled at the level of the central part of the bed around a coupling shaft 6 and 7 respectively. Two pneumatic springs 8, which are not self-locking, are each placed laterally in the central part of frame 2.

Figure 7:
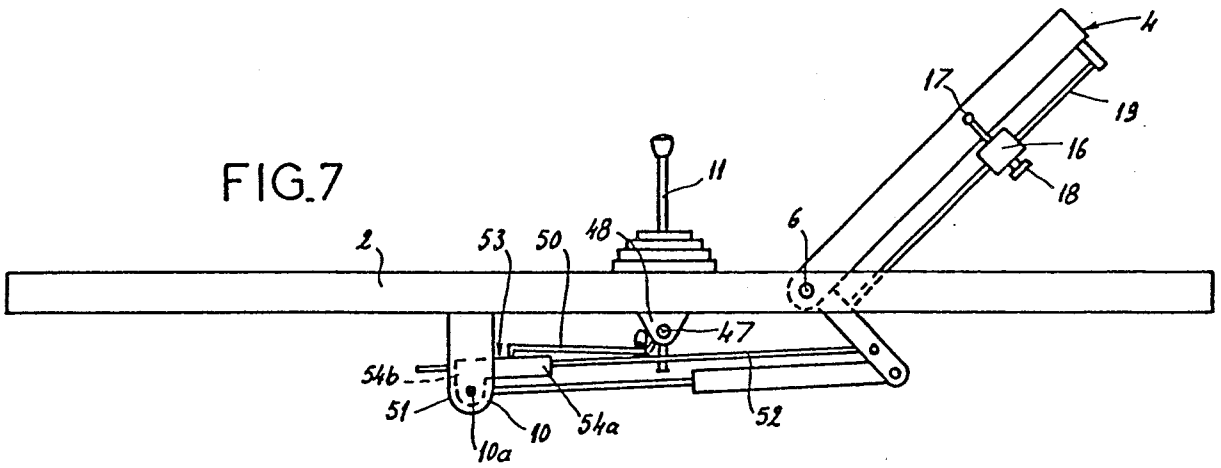
FIG. 7 is a side view of the bed frame similar to that of FIG. 6 showing one of the systems for locking a spring.

As FIG. 7 shows, each spring 8 is coupled between a mobile element 4 and 5 and a fastening lug 51 solidly connected with frame 2 and close to shaft 6 and 7 of the opposite mobile element 5 and 4, respectively. Each spring 8 is placed to cause, by its extension, upward swinging of mobile element 4 and 5 which is associated with it by rotation around its shaft 6 and 7. Coupling of this spring 8 is done in a way known in the art by means of pins **10*a* and straps 10 solidly connected with fastening lug 51 and the associated shaft 6 and 7**.

Each spring 8 exhibits a rod **8*a* mounted free in translation between two extension and retraction end positions; therefore a locking system of rod 8*a* is provided independent of pneumatic spring 8** in question and associated with unlocking means.

This locking system consists of a locking rod 52 coupled by one of its ends to shafts 6 and 7 of mobile elements 4 and 5 close to the point of coupling to shafts 6 and 7 of spring 8 with which it is associated. This locking rod 52 is placed approximately parallel to spring 8 and is connected to the free end of rod **8*a* by a connecting part 53 of a general L shape in side view and U shape in cross section. The free end of large leg 54*a* of the L, placed opposite shafts 6 and 7, is closed by an end wall 55 exhibiting a bore passed through by locking rod 52. A helical spring 56 concentric with locking rod 52 rests, by one of its ends, against end wall 55 inside connecting part 53 and exerts a thrust on a washer 57 passed through by locking rod 52 and, of a diameter slightly greater than that of said rod 52, this washer 57 resting partially against a stop 58 solidly connected with connecting part 53, so that it is kept in inclined position relative to the axis of rod 52 under the action of spring 56 and thus locks rod 52 relative to connecting part 53**.

Small leg **54*b* of L of connecting part 53 is fastened to the free end of rod 8*a* of spring 8 and to strap 10 of fastening lug 51 by pin 10*a*** or a bolt.

Of course, the length of locking rod 52 is a function of the clearance travel of rod **8*a* relative to spring 8**.

As can be seen in FIGS. 6 to 9, the means for unlocking rod **8*a* of spring 8** comprise in part the constitutive elements of the variant of the actuating system of the unlocking rod for a self-locking spring, represented in FIG. 5 and described above. Identical elements therefore are designated by the same references. Handle 11 makes it possible to put pneumatic spring 8 into movement. It is connected solidly to handle shaft 47 itself mounted so as to be rotatably mobile on anchoring lug 48 by means of a rivet.

Figure 9:
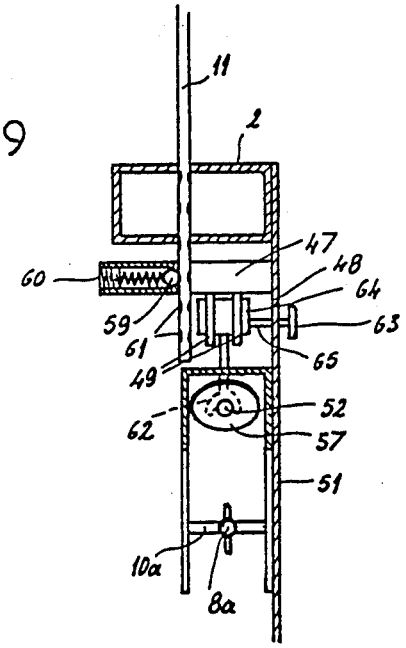
FIG. 9 is a view in cross section along line IX—IX of FIG. 8.

As FIG. 9 shows, a device, known in the art, is provided for regulating the height of handle 11 to position it relative to the mattress, this device comprising a ball 59 housed in shaft 47, thrust by a spring 60 and intended to engage in one of notches 61 made on handle 11.

Two lugs 49, welded to handle shaft 47, are coupled to one of the end of unlocking rod 50, whose other end is coupled to an unlocking fork 62 engaged in the connecting part 53 so that its U-shaped free end straddles locking rod 52 close to inclined washer 57.

During actuation of handle 11, handle shaft 47 pivots and causes the movement of unlocking rod 50 in the direction of associated mobile element 4 and 5. Unlocking fork 62 then pivots slightly and acts by its U-shaped end on washer 57 to bring it to a position in which it is approximately perpendicular to the axis of unlocking rod 52. The latter can then slide freely relative to connecting part 53 and rod 8*a* of the spring is thus actuated and can cause lifting of associated mobile element 4 and 5 as already explained above.

Figure 8:
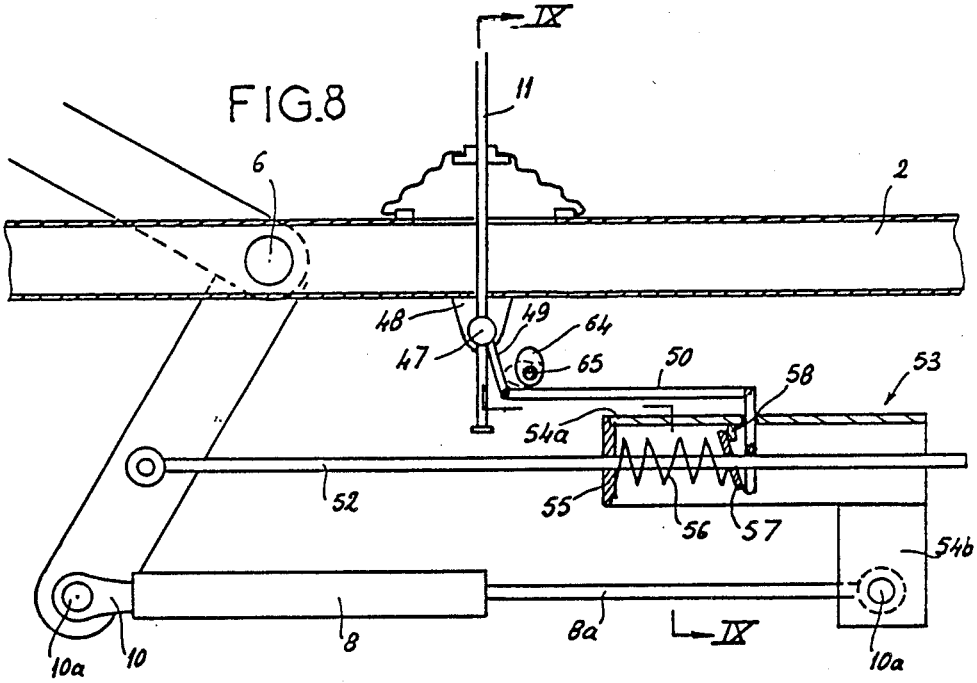
FIG. 8 is a detail view in longitudinal section of the frame of FIG. 7.

As can be seen in FIGS. 8 and 9, safety locking means are provided to prevent the consequences of any accidental maneuvering of handle 11. These means consist of a control button 63 mounted on anchoring lug 48 which is able to rotatably drive an eccentric 64 fastened to one of the ends of a shaft button 65 whose other end is solidly connected with control button 63 between a locked position, in which it rests against lugs 49 (i.e., FIG. 8, dotted lines) and thus prevents any movement of the latter, and an unlocked position, in which it is separated from lugs 49 and thus allows their movement under the action of handle 11 (i.e., FIG. 8, solid lines).

Visual indicators associated with control button 63 make it possible to know if the latter is in locked or unlocked position.

Of course, these safety locking means can also equip the system for actuating the unlocking rod of a self-locking spring 8 represented in FIG. 5.

On each of the mobile elements 4 and 5 is also placed on one of sides 4*a* and 5*a* of the latter, a bar 19 extending parallel to this side. A weight 16 is mounted to slide on this bar 19 and can be locked at a set position by a screw 18. It allows setting of the device for lifting headrest element 4 or footrest element 5 considered as a function of the weight of the person lying on the bed. A graduated scale 20 can be placed for this purpose on frame 2 of the bed, parallel to bar 19, this scale being calibrated in kilograms and graduated, for example, from 10 to 200 kg.

The operation of the lifting device headrest element 4 or footrest element 5 is the following. Once the invalid has been placed on the bed, the setting as a function of the latter's weight is made by movement of weight 16 along bar 19. When the invalid wishes to lift this element 4 or 5 from the low position, it suffices to actuate corresponding handle 11 and to lift his head or legs slightly, depending on the case, to discharge pneumatic spring 8, this action being sufficient to permit extension of the spring once it has been unlocked, as explained above.

In the second embodiment, the device according to the invention is greatly simplified: the number of parts is reduced which has an impact on the cost.

Further, the use of springs, which are not self-locking, improves safety, particularly in the case of heavy persons. Actually, self-locking springs on the market have limited capacities which broadly suffice for persons of normal weight, but which risk causing problems for very heavy persons.

Of course the invention is not limited to the embodiments described above but, rather, it takes in all variant embodiments and equivalent applications. Thus the device according to the invention could be used without weights 16 and 41 which are intended solely to reduce the force exerted by the user. In this case quite obviously the user would have to produce a certain force to raise or lower the various mobile parts.

Finally, the device according to the invention can also be adopted to raising mobile elements of chairs or the like and is not limited to raising mobile elements of a bed.

It is easy to see the advantage of the device according to the invention which can be manipulated easily by any person, even very weak or invalid.

The foregoing description of the specific embodiments will so fully reveal the general nature of the invention that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation.

I claim:

1. A device for automatically raising and lowering adjustable mobile elements of chairs and beds, comprising a pneumatic spring associated with each mobile element of the chair or bed, and placed to allow, by its extension, raising of this mobile element, and a compensation weight associated with each pneumatic spring acting against the spring and able to be moved to compensate, at rest, the force of pneumatic spring relative to the weight of a person resting on the mobile element.

2. The device according to claim 1, wherein one of the compensation weights is moveably mounted and moves, in the direction of a point of coupling of a first of the mobile elements to the chair or bed, substantially simultaneously with the actuation of unlocking control of the pneumatic springs.

3. The device according to claim 2, wherein each weight is mounted to be able to be moved along at least one bar extending in the longitudinal direction of the mobile elements.

4. The device according to claim 2, wherein each pneumatic spring is self-locking and its unlocking is performed by means of a handle connected to a shaft able to cause, by movement of a pin, the actuation of a rod of the pneumatic spring.

5. The device according to claim 1, wherein each weight is mounted to be able to be moved along at least one bar extending in the longitudinal direction of the mobile elements.

6. The device according to claim 5, wherein one of the weights is able to be locked in a set position by means of a screw.

7. The device according to claim 1, wherein movement of at least one of the weights is performed by means of a micrometer screw.

8. The device according to claim 1, wherein each pneumatic spring is self-locking and its unlocking is performed by means of a handle connected to a shaft able to cause, by movement of a pin, the actuation of a rod of the pneumatic spring.

9. The device according to claim 8, wherein the pin is engaged in a hole made in a cylindrical sleeve in which the rod of the pneumatic spring projects.

10. The device according to claim 8, wherein the movement of the first weight is performed by means of rod-link system which is connected to a first of the handles for unlocking the associated pneumatic spring.

11. The device according to claim 10, wherein the pivoting movement of the first handle is transmitted to an unlocking pin via a shaft by an eccentric system.

12. The device according to claim 10, wherein the pivoting movement of the first handle is transmitted to an unlocking pin via a shaft by a yoke on which rests one end of an actuating rod, another end of the actuating rod being provided with an unlocking pin.

13. The device according to claim 12, wherein the actuating rod exhibits several setbacks able to work with the yoke to trigger actuation of the associated pneumatic spring starting only from a certain position of the first weight which is a function of the weight of the person.

14. The device according to claim 12, wherein the shaft, fastened to an end of a crossbar located under a frame of the chair or bed, is provided with at least one boss provided to cause the pivoting of an unlocking rod of the associated spring.

15. The device according to claim 1, further comprising a safety system consisting of a rod coupled at one end to the mobile elements and able to be locked at its lower end on a frame of the bed or the chair.

16. The device according to claim 1, wherein each pneumatic spring associated with each mobile element is of the type that is not self-locking, wherein it exhibits a spring rod mounted free in translation between two extension and retraction end positions and a system is provided for unlocking the spring rod independent of the pneumatic spring associated with unlocking means.

17. The device according to claim 16, wherein safety locking means are provided consisting of a control button mounted on an anchoring lug and connected to drive a rotary eccentric fastened to one of the ends of a bottom shaft whose other end is solidly connected with said control button, wherein said control button is in a locked position when said eccentric locks handle shift lugs connecting said handle shaft to an unlock rod, whereby said unlock rod is connected to an unlocking fork, and wherein said control button is in an unlocked position when said handle shift lugs are not locked by said eccentric and said handle shaft lugs are free to move in rotation under the effect of the handle.

18. The device according to claim 16, further comprising a system for locking the spring rod comprising a locking rod coupled by one of its ends to a shaft of a mobile element and placed approximately parallel to the spring with which it is associated, said locking rod being connected to a free end of the spring rod by a connecting part which said locking rod goes through and relative to which it is locked under the effect of a washer placed around the locking rod, and said washer kept in inclined position relative to said locking rod by means of a spring concentric to said locking rod so that the spring rod, solidly connected with said connecting part, is also locked relative to the spring.

19. The device according to claim 18, wherein the connecting part comprises a general L shape in side view and U shape in cross section and a large leg of the L shape is parallel to the locking rod and comprises an end wall comprising a bore passed through by the locking rod, a small leg of the L shape being solidly connected with a strap of a fastening lug and with the spring rod by a common pin.

20. The device according to claim 18, wherein the means for unlocking said spring rod comprises a handle connected to a shaft able to actuate, by pivoting, an unlocking fork having a U-shaped free end engaged in the connecting part and which straddles the locking rod and moves a washer to a position in which said washer is perpendicular to the axis of the locking rod to free the latter relative to the connecting part and to permit the extension of the spring rod of the spring.

* * * * *